US011535924B1

(12) United States Patent
Cui et al.

(10) Patent No.: US 11,535,924 B1
(45) Date of Patent: Dec. 27, 2022

(54) METHOD FOR SURFACE-MODIFYING TITANIUM ALLOY

(71) Applicant: Southwest Jiaotong University, Chengdu (CN)

(72) Inventors: Guodong Cui, Chengdu (CN); Dazhi Chen, Chengdu (CN); Chengsong Zhang, Chengdu (CN)

(73) Assignee: SOUTHWEST JIAOTONG UNIVERSITY, Chengdu (CN)

( * ) Notice: Subject to any disclaimer, the term of this patent is extended or adjusted under 35 U.S.C. 154(b) by 0 days.

(21) Appl. No.: 17/867,738

(22) Filed: Jul. 19, 2022

(30) Foreign Application Priority Data

Dec. 9, 2021 (CN) ..... 202111495238.2

(51) Int. Cl.
*C23C 8/64* (2006.01)
*C23C 8/28* (2006.01)
*C23C 8/02* (2006.01)

(52) U.S. Cl.
CPC ..... *C23C 8/64* (2013.01); *C23C 8/02* (2013.01); *C23C 8/28* (2013.01)

(58) Field of Classification Search
CPC ..... C23C 8/64; C23C 8/02; C23C 8/28
See application file for complete search history.

(56) References Cited

U.S. PATENT DOCUMENTS

2009/0205751 A1 8/2009 Wu

FOREIGN PATENT DOCUMENTS

| | | | |
|---|---|---|---|
| CN | 104328376 | A | 2/2015 |
| CN | 109321871 | A | 2/2019 |
| CN | 110643933 | A | 1/2020 |
| JP | H1143760 | A | 2/1999 |
| JP | 2015147970 | A | 8/2015 |
| RU | 2075536 | C1 | 3/1997 |

OTHER PUBLICATIONS

Duan, et al. "Effect of solid carburization on surface microstructure and hardness of Ti-6Al-4V alloy and (TiB+La2O3)/Ti-6Al-4V composite" Trans. Nonferrous Met. Soc. China 26(2016) 1871-1877.

*Primary Examiner* — Jessee R Roe
(74) *Attorney, Agent, or Firm* — Mayer & Williams PC; Stuart Mayer

(57) ABSTRACT

Disclosed is a method for surface-modifying titanium alloy, comprising the following steps: carburizing titanium alloy in solid carburizing agent A and solid carburizing agent B, and then performing gas co-infiltration to realize surface modification treatment of titanium alloy; the solid carburizing agent A includes raw materials of charcoal powder a, barium carbonate, calcium carbonate, barium acetate, urea and cerium carbonate, and the solid carburizing agent B includes raw materials of charcoal powder b, barium carbonate, calcium carbonate and cerium carbonate; and the gases used in the gas co-infiltration are ammonia, air and acetylene.

5 Claims, 6 Drawing Sheets

METHOD FOR SURFACE-MODIFYING TITANIUM ALLOY

CROSS-REFERENCE TO RELATED APPLICATIONS

This application claims priority to Chinese Patent Application No. 202111495238.2, filed on Dec. 9, 2021, the contents of which are hereby incorporated by reference.

TECHNICAL FIELD

The application relates to the technical field of titanium alloy, and in particular to a method for surface-modifying titanium alloy.

BACKGROUND

Along with the development of high-end equipment manufacturing industry, a higher requirement is put forward for various components, and not only the comprehensive mechanical properties and safe service life of various key components, but also the effect of weight reduction and energy saving during the operation of the equipment are taken into account. Following the development of the economy and environmental protection requirements, weight reduction and energy saving has become the major orientation of the high-end equipment manufacturing industry. Titanium alloy, whose performance is close to that of high-strength steel but with less than 60% of the density of steel, is the material of top choice for replacing steel in the manufacture of key components for high-end equipment, and titanium and titanium alloy products are gradually replacing some steel parts in the manufacture of high-end equipment. However, titanium alloy has low superficial hardness and low wear resistance, which limits its application in work molds, gears, bearings and other key components. Besides, the method for modifying titanium alloy surface is not as easy as that of steel materials, which also limits the application scope of titanium alloy.

In the prior art, there are mainly coating technology, ion implantation technology and chemical heat treatment technology for surface treatment of titanium alloy. The coating technology and ion implantation technology can develop a high hardness on the surface of titanium alloy, but it is difficult to obtain a relatively thick surface treatment layer, which limits the application on medium and heavy-duty parts and work molds; as for chemical heat treatment technology for titanium alloy surface treatment, although a layer of several tens of microns thick can be obtained, it is still very thin compared with the surface layer of several hundred microns or even several millimeters thick on the surface of steel parts. Moreover, as adopting chemical heat treatment for titanium alloy, the brittleness of the surface will increase significantly when the layer is thicker, resulting in increased brittleness of the treated titanium alloy products, which seriously affects the service life and safety of the titanium alloy products. Therefore, there is an urgent need for a method for modifying the surface of titanium alloy that enables titanium alloy with properties of steel surfaces treated by chemical heat treatment.

SUMMARY

On the basis of the above, the present application provides a method for surface-modifying titanium alloy, which improves the efficiency of titanium alloy surface modification treatment; by applying the method, a surface hardened layer of several hundred microns in thickness is obtained in a short period of time, with brittleness significantly lower than that of samples treated by conventional chemical heat treatment techniques, and the obtained layer reaches the level of steel surface treated by chemical heat treatment.

One of the technical schemes of the present application provides a method for surface-modifying titanium alloy, including: carburizing titanium alloy in solid carburizing agent A and solid carburizing agent B, followed by gas co-infiltration to achieve surface modification of titanium alloy.

The solid carburizing agent A includes raw materials of charcoal powder a, barium carbonate, calcium carbonate, barium acetate, urea and cerium carbonate.

The solid carburizing agent B includes raw materials of charcoal powder b, barium carbonate, calcium carbonate and cerium carbonate.

The gas co-infiltration uses gases of ammonia, air and acetylene.

Optionally, the charcoal powder a has a particle size in a range of 0.5-1 millimeter (mm), and the charcoal powder b has a particle size in a range of 1-3 mm; the titanium alloy is an alpha+beta (TC) or a beta (TB) titanium alloy.

The smaller the particle size of the charcoal powder, the larger the surface area, the larger the contact area with the titanium alloy, the more active carbon atoms produced by decomposition, and the better the carburizing effect. Yet, the smaller the particle size, the easier the charcoal powder is to compact and the denseness increases, which is not conducive to the flow of the gases produced during carburization and will affect the carburization effect.

In order to achieve a better carburizing effect while promoting the flow of gas generated during the carburizing process, the application makes improvements by selecting a solid carburizing agent A consisting of a layer of fine charcoal powder close to the sample, followed by a layer of solid carburizing agent B consisting of a relatively coarse charcoal powder, which can increase the contact area of the solid carburizing agent with the workpiece while improving the flow of gas, thus achieving a good surface modification effect on titanium alloy.

The particle size of charcoal powder a used in this application should not be too fine, since too fine a particle size will cause high costs of preparation and agglomeration of raw materials, and bring difficulty in uniformly of mixing with other raw materials, so the particle size of charcoal powder a is selected to be in a range of 0.5-1 mm.

Optionally, the solid carburizing agent A includes raw materials according to the following dosage by mass fraction: charcoal powder a: 80-82 percent (%) by mass fraction; barium carbonate: 8-10% by mass fraction; calcium carbonate: 3-5% by mass fraction; barium acetate: 2% by mass fraction; urea: 2% by mass fraction; cerium carbonate: 1% by mass fraction.

Optionally, the solid carburizing agent B includes raw materials according to the following dosage by mass fraction: charcoal powder b: 84-86% by mass; barium carbonate: 8-10%; calcium carbonate: 3-5%; cerium carbonate: 1%.

The chemicals involved above are technical grade.

Charcoal powder, barium carbonate and calcium carbonate are used as raw materials in conventional solid carburizing, mainly for the surface carburizing treatment of steel parts, while the present application is developed mainly for the surface treatment of titanium alloy, where the conventional solid carburizing agent is improved by adding with a small amount of barium acetate, urea and cerium carbonate; with a small amount of barium acetate and urea added to the solid carburizing agent of fine charcoal powder on the surface of titanium alloy, a decomposition reaction of barium acetate and urea is utilized to purify and activate the surface of titanium alloy and improve the carburizing efficiency; however, in case of excessive addition, the decomposition reaction of barium acetate and urea prevents the activated carbon from contacting the surface of the titanium alloy, thus affecting the carburizing effect. Further, cerium carbonate is added in a small amount to act as a catalyst so as to accelerate the carburizing process.

Optionally, the gas co-infiltration is carried out at 25 degree Celsius (° C.) under 1 standard atmospheric pressure, using ammonia, air and acetylene with a volume ratio of 20:2:1.

Gas co-infiltration mainly involves nitrogen and oxygen, with ammonia providing the active nitrogen; air and acetylene combust to produce a certain amount of carbon dioxide and carbon monoxide, which can react with the hydrogen produced by the decomposition of ammonia to promote the process of nitrogen infiltration while reducing the impact of hydrogen; in the process of co-infiltration, a small amount of carbon and oxygen also penetrate into the surface of the titanium alloy; gas co-infiltration is carried out on the basis of solid carburization, and a C (carbon), N (nitrogen) and O (oxygen) co-infiltration layer is then formed on the surface of the titanium alloy to further improve the surface hardness and wear resistance of the titanium alloy; as a result of gas co-infiltration, the surface hardness may be increased by 10-20%.

In addition, the solid carburizing is carried out at the temperature of solution treatment of the titanium alloy, and the carburizing is followed by water cooling and quenching to achieve the solution treatment of the titanium alloy matrix at the same time; besides, carrying out the gas co-infiltration under temperature of aging treatment of titanium alloy can achieve the effect of aging strengthening of the titanium alloy matrix at the same time.

Further, the method specifically comprises the following steps:

(1) covering the surface of the titanium alloy with solid carburizing agent A after a primary sandblasting treatment, followed by covering with solid carburizing agent B; carrying out carburizing treatment to the titanium alloy and then transferring the treated titanium alloy to water for cooling to 20 to 40° C.; and (2) carrying out gas co-infiltration treatment on the titanium alloy treated by step (1) after secondary sandblasting treatment, and air-cooling the co-infiltrated titanium alloy to 20-40° C.

Optionally, the primary sandblasting treatment in the step (1) adopts 100-mesh carborundum with a machining margin of 5 to 10 micrometer (μm).

Optionally, the secondary sandblasting treatment in the step (2) adopts 150-mesh carborundum.

Optionally, in the step (1), the solid carburizing agent A achieves a covering thickness of 2 mm, and the solid carburizing agent B achieves a covering thickness of 5-8 mm.

Optionally, in the process of gas co-infiltration in step (2), ammonia and air are firstly introduced in proportion, and acetylene is then introduced in proportion after the tail gas (hydrogen, nitrogen, residual ammonia generated by ammonia decomposition, water vapor generated by hydrogen reacting with air, etc.) is fully burned;

In this process, an empty furnace is heated to 550° C. firstly and then added with titanium alloy workpiece after solid carburizing treatment, followed by ammonia and air introduced in proportion so as to expel the original atmosphere; and acetylene gas is introduced in proportion after the tail gas is fully burned, so as to ensure operational safety and avoid operational hazards.

Optionally, the carburizing treatment in step (1) is carried out at 875° C.-950° C. for 2-6 hours (h).

Optionally, the gas co-infiltration treatment in step (2) is carried out at 550° C. for 2-6 h.

Another technical scheme of the present application provides a titanium alloy obtained by the method for surface-modifying titanium alloy.

Another technical scheme of the present application provides an application of the titanium alloy in tools, molds, bearings and gears.

Compared with the prior art, the present application has the advantages that:

by solid carburizing the titanium alloy followed by gas co-patination, solid carburizing, the present application achieves a reduction in deformation of the treated titanium alloy workpiece and a reduction in brittleness caused by hydrogen infiltration; solid carburizing with water cooling allows simultaneous solution treatment and, after solid co-carburizing, gas co-infiltration at aging temperature allows further infiltration of nitrogen, carbon and oxygen elements, which further increases the surface hardness while achieving aging strengthening effects; further, the addition of barium acetate, urea and cerium carbonate to the solid carburizing agent not only helps to purify and activate the surface of the titanium alloy, but also has a significant effect of promoting carburization and increasing the carburization rate; as a result, a thicker hardened layer is obtained shortly with significantly improved wear resistance, providing important technical support for the application of titanium alloy in key components such as tools, molds, gears and bearings.

On the basis of conventional solid carburizing and gas co-infiltration, the present application achieves a significantly improved efficiency of surface modification treatment of titanium alloy by changing the composition and ratio of the carburizing agent and improving the pre-treatment process and technical process, and obtains a surface hardened layer of several hundred microns thickness in a short time, with brittleness significantly lower than that of samples treated by conventional chemical heat treatment technology, and the obtained titanium alloy has other properties equal to that of samples treated by conventional chemical heat treatment technology; the method provided by the present application achieves relatively good application performance when being applied to the surface treatment of titanium alloy tools, and provides important technical support for the manufacture and application of titanium alloy replacing high-strength steel samples in high-end equipment.

DETAILED DESCRIPTION OF THE EMBODIMENTS

Figure 1:
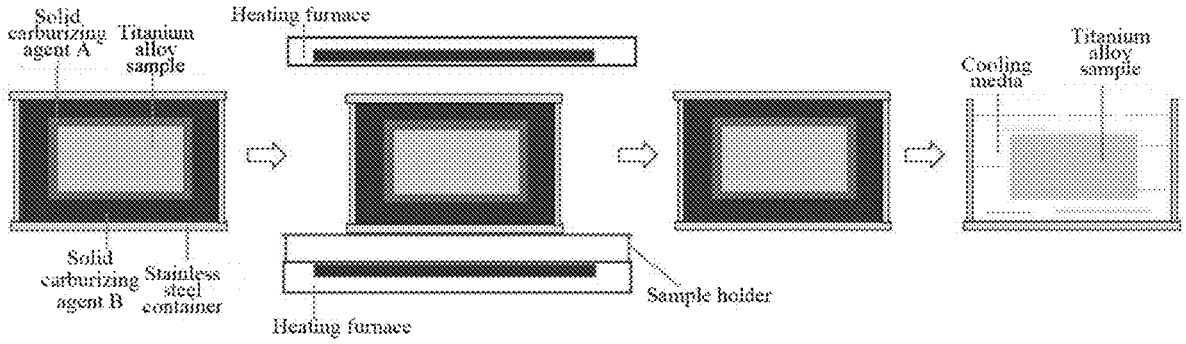
FIG. 1 shows a schematic diagram of solid carburizing process of titanium alloy sample in Embodiment 1 of the present application.

Now various exemplary embodiments of the present application will be described in detail. This detailed description should not be taken as a limitation of the present application, but should be understood as a more detailed description of some aspects, characteristics and embodiments of the present application.

It should be understood that the terms mentioned in the present application are only used to describe specific embodiments, and are not used to limit the present application. In addition, for the numerical range in the present application, it should be understood that each intermediate value between the upper limit and the lower limit of the range is also specifically disclosed. Every smaller range between any stated value or the intermediate value within the stated range and any other stated value or the intermediate value within the stated range is also included in the present application. The upper and lower limits of these smaller ranges can be independently included or excluded from the range.

Unless otherwise stated, all technical and scientific terms used herein have the same meanings commonly understood by those of ordinary skill in the field to which this application relates. Although the present application only describes preferred methods and materials, any methods and materials similar or equivalent to those described herein can be used in the practice or testing of the present application. All documents mentioned in this specification are incorporated by reference to disclose and describe the methods and/or materials related to the documents. In case of conflict with any incorporated documents, the contents of this specification shall prevail.

Without departing from the scope or spirit of the present application, it is obvious to those skilled in the art that many modifications and changes may be made to the specific embodiments of the present specification. Other embodiments obtained from the description of the present application will be obvious to the skilled person. The description and embodiment of that application are only exemplary.

As used in this paper, the terms "comprising", "including", "having" and "containing" are all open terms, meaning including but not limited to.

The charcoal powder and technical grade barium carbonate, calcium carbonate, barium acetate, urea, cerium carbonate, etc. with a particle size of less than 50 mesh used in the following embodiments of the present application are all commercially acquired and subject to no other special requirements.

Embodiment 1

(1) preparing a solid carburizing agent A according to a mass percentage, including 80 percent (%) of charcoal powder a with a particle size of 0.5 millimeter (mm), 10% of barium carbonate, 5% of calcium carbonate, 2% of barium acetate, 2% of urea and 1% of cerium carbonate;

(2) preparing a solid carburizing agent B, including 84% of charcoal powder b with a particle size of 1 mm, 10% of barium carbonate, 5% of calcium carbonate and 1% of cerium carbonate;

(3) performing sandblasting treatment to a TC4 titanium alloy workpiece with 100-mesh carborundum with a machining margin of 5 micrometer (μm), burying the sandblasted TC4 titanium alloy in a stainless steel container filled with solid carburizing agent A and solid carburizing agent B, where the TC4 titanium alloy workpiece is firstly covered with 2 mm thick solid carburizing agent A on its surface, then covered with 5 mm thick solid carburizing agent B; putting the TC4 titanium alloy workpiece together with the stainless steel container into a heating furnace, heating the furnace at a heating rate of 20 degree Celsius per minute (° C/min) to a target temperature (900° C.) of solid carburization, carrying out solid carburization for 2 hours, then taking out the TC4 titanium alloy workpiece and immediately transferring it into a cooling medium (water), and cooling to 20° C. with stirring; see FIG. 1 for the schematic diagram of solid carburizing process of the titanium alloy sample.

Figure 2:
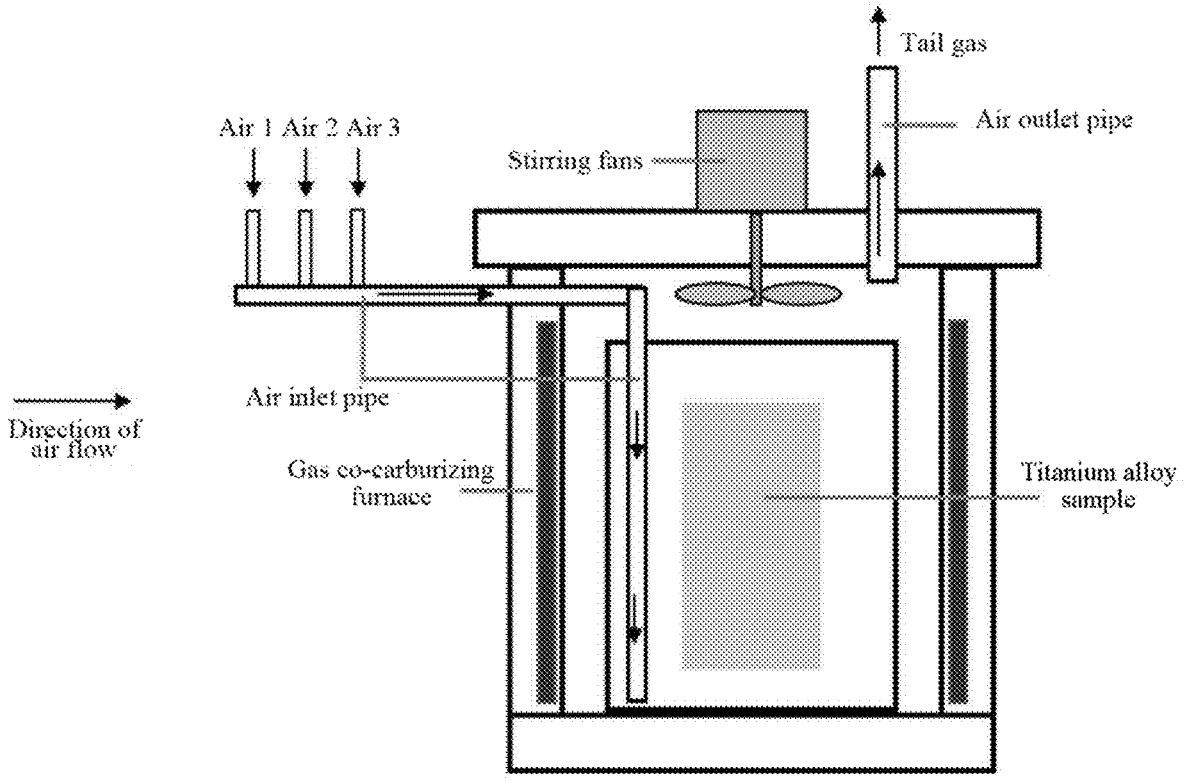
FIG. 2 shows a schematic diagram of gas co-infiltration process of titanium alloy sample in Embodiment 1 of the present application.

(4) fining the TC4 titanium alloy workpiece on the surface after the solid carburizing treatment in step (3), removing the machining margin and then blasting the surface with 150-mesh carborundum; and (5) transferring the TC4 titanium alloy workpiece treated in step (4) into a gas co-carburizing furnace for gas co-infiltration at 550° C. for 2 hours, where the gas used is ammonia, air and acetylene with a volume ratio of 20:2:1 at 25° C. and 1 standard atmospheric pressure, and specifically, introducing ammonia and air in proportion firstly, and then introducing acetylene in proportion after the tail gas is fully burned; taking out the workpiece after co-infiltration, cooling the workpiece to room temperature to obtain surface modified TC4 titanium alloy workpiece; see FIG. 2 for the schematic diagram of gas co-infiltration of titanium alloy sample.

Figure 3:
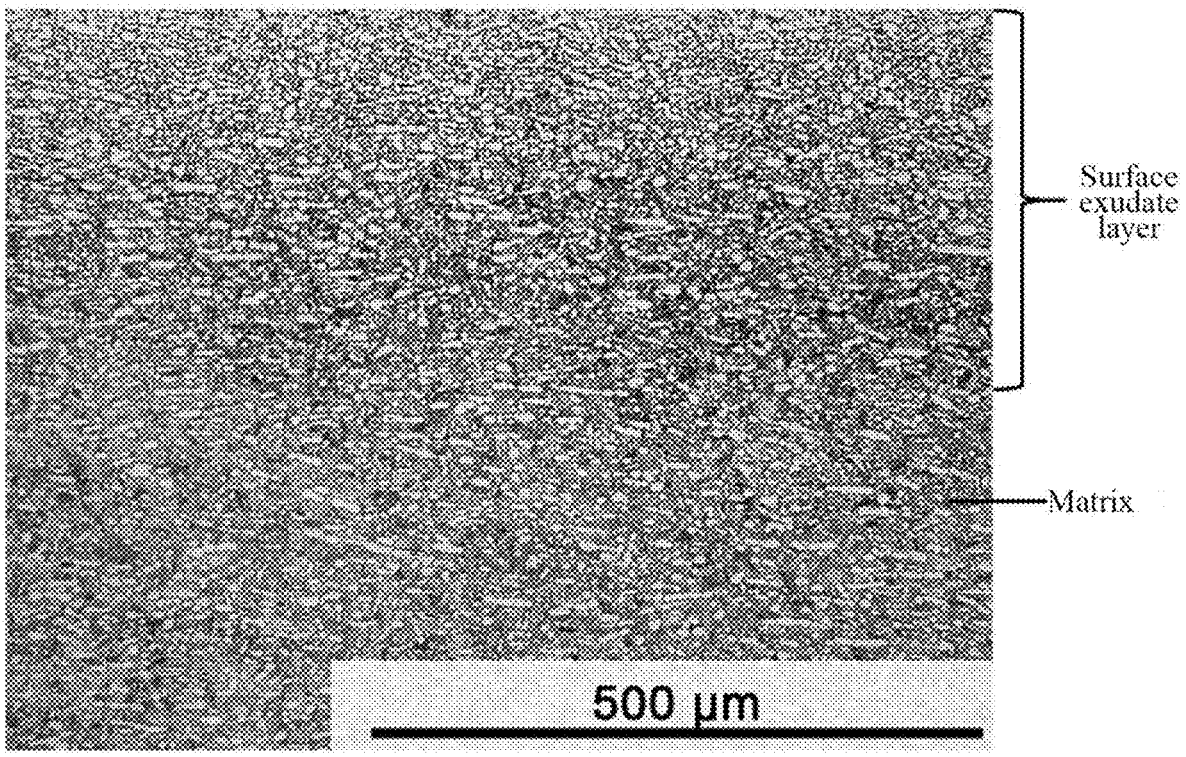
FIG. 3 shows a metallographic diagram of the titanium alloy sample of Embodiment 1 of the present application after solid carburizing+gas co-infiltration.

TC4 titanium alloy workpiece after step (5) is subjected to metallographic examination, and the results are shown in FIG. 3; it can be concluded from FIG. 3 that the surface of the TC4 titanium alloy workpiece treated by this embodiment produces a surface exudate layer of about 200 μm, and the surface exudate layer is significantly refined in terms of structure compared to the matrix, with a large number of white separation.

Figure 4:
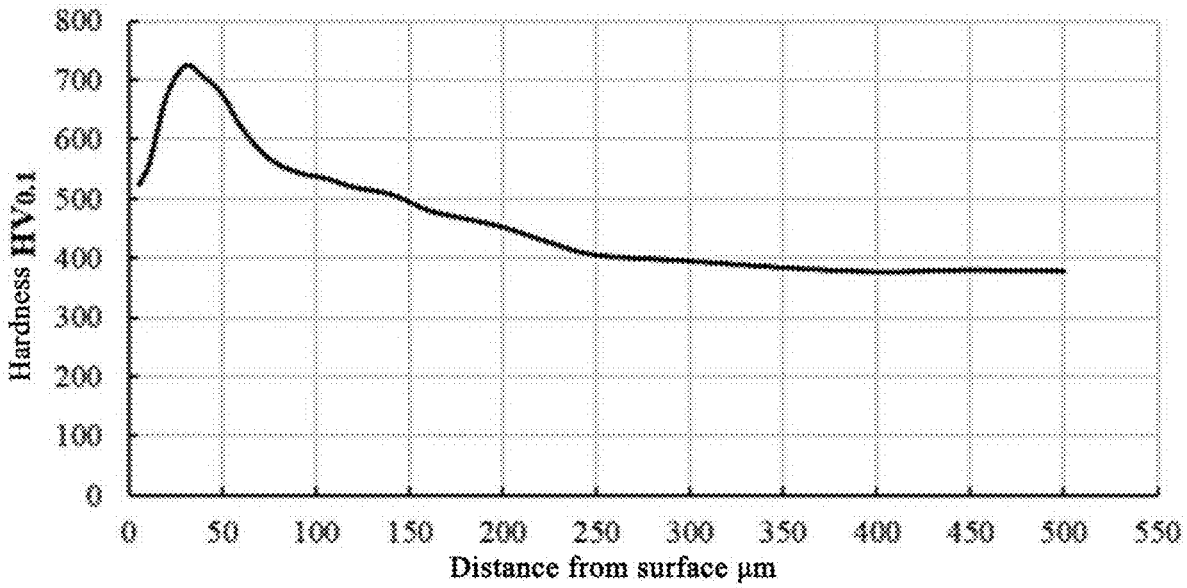
FIG. 4 illustrates a hardness distribution of the titanium alloy sample in Embodiment 1 of the present application after solid carburizing+gas co-infiltration.

TC4 titanium alloy workpiece after step (5) is subjected to hardness distribution analysis, and the results are shown in FIG. 4; it can be seen from FIG. 4 that the TC4 titanium alloy workpiece has an obviously improved surface hardness and a slightly loose outermost layer after treatment, where the hardness of outermost layer is slightly lower than that of the subsurface layer; and the wear resistance of the treated sample is 3.5 times higher than that of the untreated sample under the same conditions according to the sliding friction and wear test.

Figure 5:
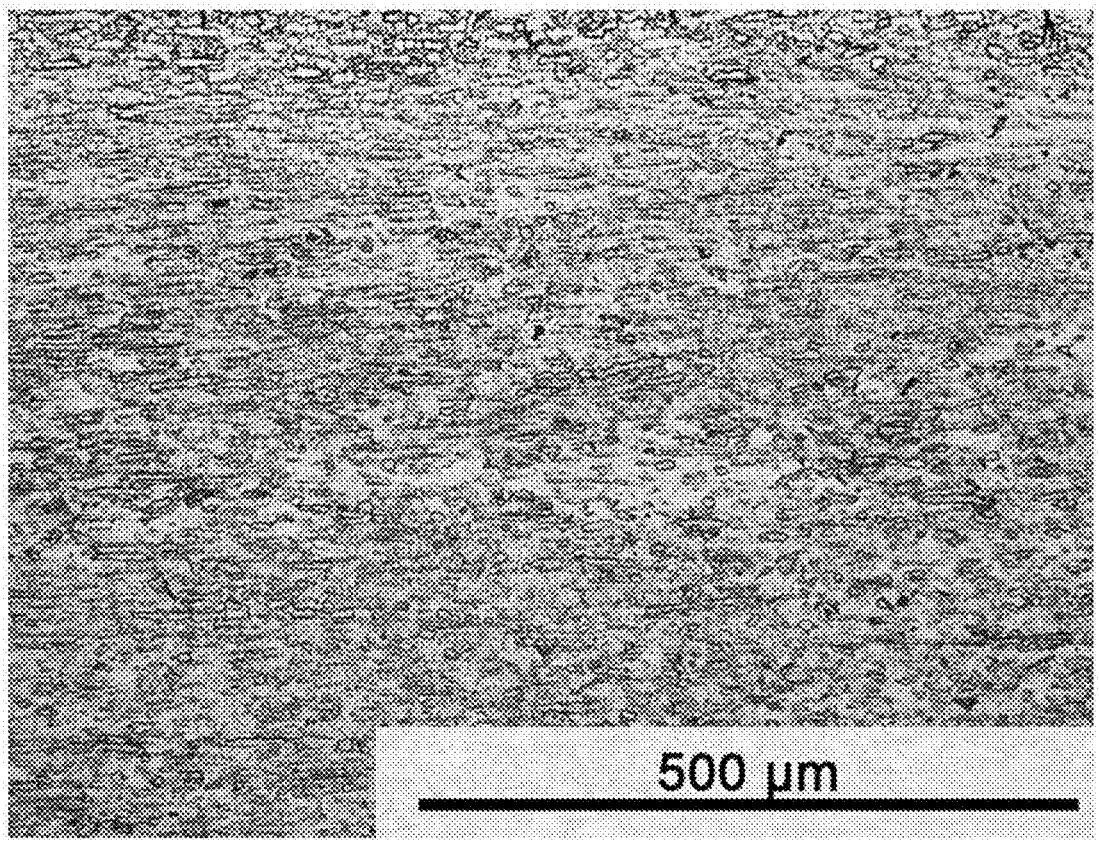
FIG. 5 shows a metallographic diagram of Embodiment 1 of the present application only after solid carburization.
Figure 6:
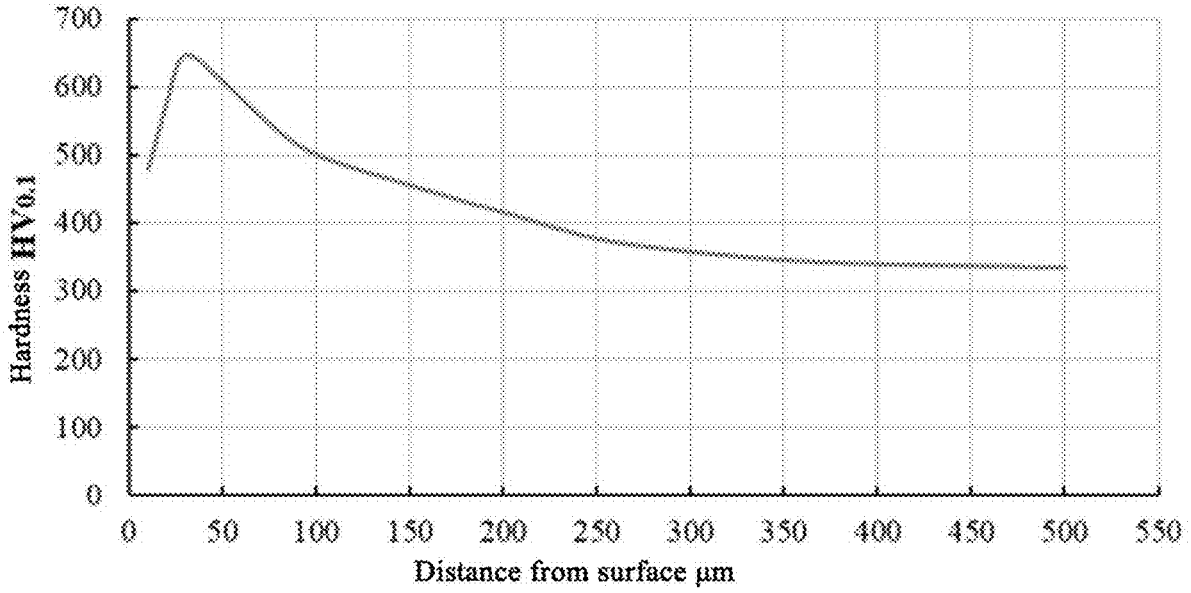
FIG. 6 illustrates a hardness distribution of Embodiment 1 of the present application after only solid carburizing.

TC4 titanium alloy workpiece treated only by solid carburizing in step (3) is subjected to metallographic analysis and hardness distribution analysis; it can be seen from the results shown in FIGS. 5-6 that the trend of overall hardness of TC4 titanium alloy workpiece treated only by solid carburizing in step (3) is similar to that of TC4 titanium alloy workpiece treated after step (5), but the hardness value is significantly lower than that of TC4 titanium alloy workpiece treated after step (5), indicating that the hardness of TC4 titanium alloy workpiece has been further improved after gas co-infiltration.

Embodiment 2

The present embodiment is different from Embodiment 1 in that:

(1) a solid carburizing agent A is prepared according to a mass percentage, including 82 percent (%) of charcoal powder a with a particle size of 1 millimeter (mm), 8% of barium carbonate, 5% of calcium carbonate, 2% of barium acetate, 2% of urea and 1% of cerium carbonate;

(2) a solid carburizing agent B is prepared by including 86% of charcoal powder b with a particle size of 3 mm, 8% of barium carbonate, 5% of calcium carbonate and 1% of cerium carbonate; and (3) the solid carburizing agent B achieves a coating thickness of 8 mm, the target temperature of solid carburization is 875° C., and the solid carburization is carried out for 6 h;

the results show that the surface layer of TC4 titanium alloy workpiece is about 240 μm, and the highest hardness of the layer may reach 750 Vickers hardness (HV).

Embodiment 3

The present embodiment is different from Embodiment 1 in that the target temperature of solid carburizing in step (3) is 950° C., the solid carburization is carried out for 4 h, and the TC4 titanium alloy workpiece is cooled to 40° C. after taken out; the results show that the surface of TC4 titanium alloy workpiece has a surface infiltration layer of about 300 μm, and the hardness of the surface layer may reach 775 HV.

Embodiment 4

The present embodiment is different from Embodiment 1 in that the gas co-infiltration of step (5) is carried out for 6 h; and the results show that the surface layer of TC4 titanium alloy workpiece is about 220 μm, and the highest hardness of the surface layer can reach 800 HV.

In addition to the above embodiments, the application also verifies the performance of the titanium alloy treated by the surface modifying method of the application when it is a beta titanium alloy, and the results show that the treated titanium alloy has the same or similar technical effect, indicating that the surface modifying method of the application may greatly improve the efficiency of titanium alloy surface treatment and significantly improve the treatment effect; by applying the method, a thicker hardened layer can be obtained in a short time, and the wear resistance is obviously improved, while the core retains good toughness and plasticity. The method provides important technical support for the application of titanium alloy in tools, molds, gears, bearings and other key parts.

The above are only preferred embodiments of the present application, and are not intended to limit the present application. Any modification, equivalent substitution and improvement made within the spirit and principle of the present application should fall in the scope of protection of the present application.

What is claimed is:

1. A method for surface-modifying titanium alloy, wherein titanium alloy is carburized in solid carburizing agent A and solid carburizing agent B, followed by gas co-infiltration to achieve surface modification of titanium alloy;

wherein the solid carburizing agent A includes raw materials of charcoal powder a, barium carbonate, calcium carbonate, barium acetate, urea and cerium carbonate;

wherein the solid carburizing agent B includes raw materials of charcoal powder b, barium carbonate, calcium carbonate and cerium carbonate;

wherein the gas co-infiltration uses gases of ammonia, air and acetylene;

wherein the charcoal powder a has a particle size in a range of 0.5-1 millimeter (mm), and the charcoal powder b has a particle size in a range of 1-3 mm; the titanium alloy is an alpha+beta (TC) or a beta (TB) titanium alloy;

specifically comprising the following steps:

(1) covering the surface of the titanium alloy with solid carburizing agent A after a primary sandblasting treatment, followed by covering with solid carburizing agent B; carrying out carburizing treatment to the titanium alloy and then transferring the treated titanium alloy to water for cooling to 20 to 40 degree Celsius (° C.); and (2) carrying out gas co-infiltration treatment on the titanium alloy treated by step (1) after secondary sandblasting treatment and air-cooling the co-infiltrated titanium alloy to 20-40° C.;

wherein the solid carburizing agent A includes raw materials according to the following dosages by mass fraction: charcoal powder a: 80-82 percent (%) by mass fraction; barium carbonate: 8-10% by mass fraction; calcium carbonate: 3-5% by mass fraction; barium acetate: 2% by mass fraction; urea: 2% by mass fraction; cerium carbonate: 1% by mass fraction;

wherein the solid carburizing agent B includes raw materials according to the following dosage by mass fraction: charcoal powder b: 84-86% by mass; barium carbonate: 8-10%; calcium carbonate: 3-5%; cerium carbonate: 1%.

2. The method according to claim 1, wherein the gases used in the gas co-infiltration are ammonia, air and acetylene with a volume ratio of 20:2:1 at 25° C. and 1 standard atmospheric pressure.

3. The method according to claim 1, wherein the primary sandblasting treatment in the step (1) adopts 100-mesh carborundum with a machining margin of 5 to 10 micrometer (μm); the secondary sandblasting treatment in the step (2) adopts 150-mesh carborundum.

4. The method according to claim 1, wherein in the step (1), the solid carburizing agent A achieves a covering thickness of 2 mm, and the solid carburizing agent B achieves a covering thickness of 5-8 mm; in the process of gas co-infiltration in step (2), ammonia and air are firstly introduced in proportion, and acetylene is then introduced in proportion after the tail gas is fully burned.

5. The method according to claim 1, wherein the carburizing treatment in step (1) is carried out at 875° C.-950° C. for 2-6 hours (h); and the gas co-infiltration treatment in step (2) is carried out at 550° C. for 2-6 h.

* * * * *